United States Patent [19]

Santos

[11] Patent Number: 5,037,487

[45] Date of Patent: Aug. 6, 1991

[54] SPRAY HANGER FOR WET SUIT

[76] Inventor: Marc J. Santos, 13871 Claremont St., Westminister, Calif. 92683

[21] Appl. No.: 472,907

[22] Filed: Jan. 31, 1990

[51] Int. Cl.[5] ..... B08B 3/02

[52] U.S. Cl. ..... 134/22.1; 134/42; 134/166 R; 134/115; 134/201; 134/198; 239/36

[58] Field of Search ..... 134/166 R, 115 R, 197, 134/198, 170, 201, 22.1, 42; 34/106; 223/85, 86, 92; 237/36, 435; 68/205 R

[56] References Cited

U.S. PATENT DOCUMENTS

| | | | |
|---|---|---|---|
| 2,303,313 | 12/1942 | Abbens | 223/86 |
| 2,408,749 | 10/1946 | Berg . | |
| 2,461,149 | 2/1949 | Ericson | 223/86 |
| 2,699,661 | 1/1955 | Olson . | |
| 3,686,899 | 8/1972 | Rosenfeld et al. . | |
| 3,827,262 | 8/1974 | Manuel . | |
| 4,231,239 | 11/1980 | Lazaroff . | |
| 4,592,497 | 6/1986 | Georges | 223/85 |
| 4,653,295 | 3/1987 | Clifford | 68/205 R |
| 4,655,235 | 4/1987 | Scott, Jr. . | |
| 4,729,394 | 3/1988 | Timmes et al. . | |
| 4,949,739 | 8/1990 | Ryan | 134/166 R |

FOREIGN PATENT DOCUMENTS

| | | | |
|---|---|---|---|
| 1261277 | 4/1961 | France | 223/86 |

*Primary Examiner*—Frankie L. Stinson

*Attorney, Agent, or Firm*—Knobbe, Martens, Olson & Bear

[57] ABSTRACT

A spray hanger for a wet suit comprises a hook, a pair of horizontally extending arms for supporting the wet suit, a body depending from the center of the arms, and an inlet hose coupling for connecting the hanger to a water source. Spray jets are positioned at the end of each of the arms, for spraying water through the arms of the wet suit to thoroughly rinse the inside of the arms. A plurality of spray jets are also provided throughout the body portion of the hanger to rinse the inside of the wet suit.

6 Claims, 4 Drawing Sheets

SPRAY HANGER FOR WET SUIT

BACKGROUND OF THE INVENTION

The present invention relates generally to a device for conveniently and thoroughly cleansing a wet suit.

Wet suits are commonly used in many recreational activities, such as surfing, scuba diving and water skiing. When worn during such activities, particularly in salt water, it is very important that the suit be thoroughly cleansed, and thereafter dried to preserve the life of the suit.

Heretofore, it has been difficult to adequately clean the salt, sand, dirt and sea water from the wet suit. Typically, the wet suit is laid on the ground or draped over a fence, and then hosed down with a water hose. After rinsing one side of the wet suit, one needs to lift the suit, hose down the area where the suit was lying, and then turn the suit over to rinse the other side. The wet suit then needs to be turned inside out to clean the inside of the suit, and the process repeated.

SUMMARY OF THE INVENTION

Briefly, the preferred embodiment of the present invention comprises a spray hanger for conveniently hanging and thoroughly cleansing a wet suit. The wet suit hanger includes a plurality of spray heads, connected to an inlet hose coupling. Disposed near the inlet hose coupling is a hook portion for hanging the wet suit hanger. The inlet hose coupling is in fluid communication with a length of conduit which feeds into a cross-connector. A pair of support hanger arms extend outwardly from opposite sides of the cross-connector, each arm being equipped with a spray head at its distal end. An axially elongate rectangular body, having a plurality of spray heads mounted therein, is disposed opposite the conduit which leads to the hose coupling.

A significant advantage of the present invention is that the wet suit does not have to be turned inside out in order to thoroughly rinse out the inside surfaces of the suit. Rather, the wet suit is simply hung on the wet suit hanger of this invention, with the extending arms serving the function of a "coat hanger." The spray heads at the distal ends of these arms face downwardly, into the sleeves of the wet suit. The hook portion is then hung from a suitable place, such a garage door, so as to suspend the hanger and wet suit above the ground. A hose is then connected to the inlet hose coupling, and turned on. Water flows from the hose, through the conduit and exits the hanger through the spray heads, thereby thoroughly rinsing the wet suit.

A particular feature of the invention is that the front and back of the set suit are maintained spaced apart during cleaning so that they do not cling together so as to prevent their entire surfaces from being rinsed off. For this purpose, a pair of straight arms, coupled to the elongate rectangular body so as to be generally perpendicular with this body and the front and back sides of the wet suit so as to maintain the wet suit in an open condition while water from the spray heads courses through the wet suit.

A further advantage of the preferred embodiment of the invention is that the device collapses to an easily stored unitary structure having a thickness substantially smaller than the thickness of the spray hanger in use.

BRIEF DESCRIPTION OF THE DRAWINGS

Further objects, features and advantages of the instant invention will become apparent from the ensuing detailed description, when considered together with the appended drawings in which.

DETAILED DESCRIPTION OF THE PREFERRED EMBODIMENT

Figure 1:
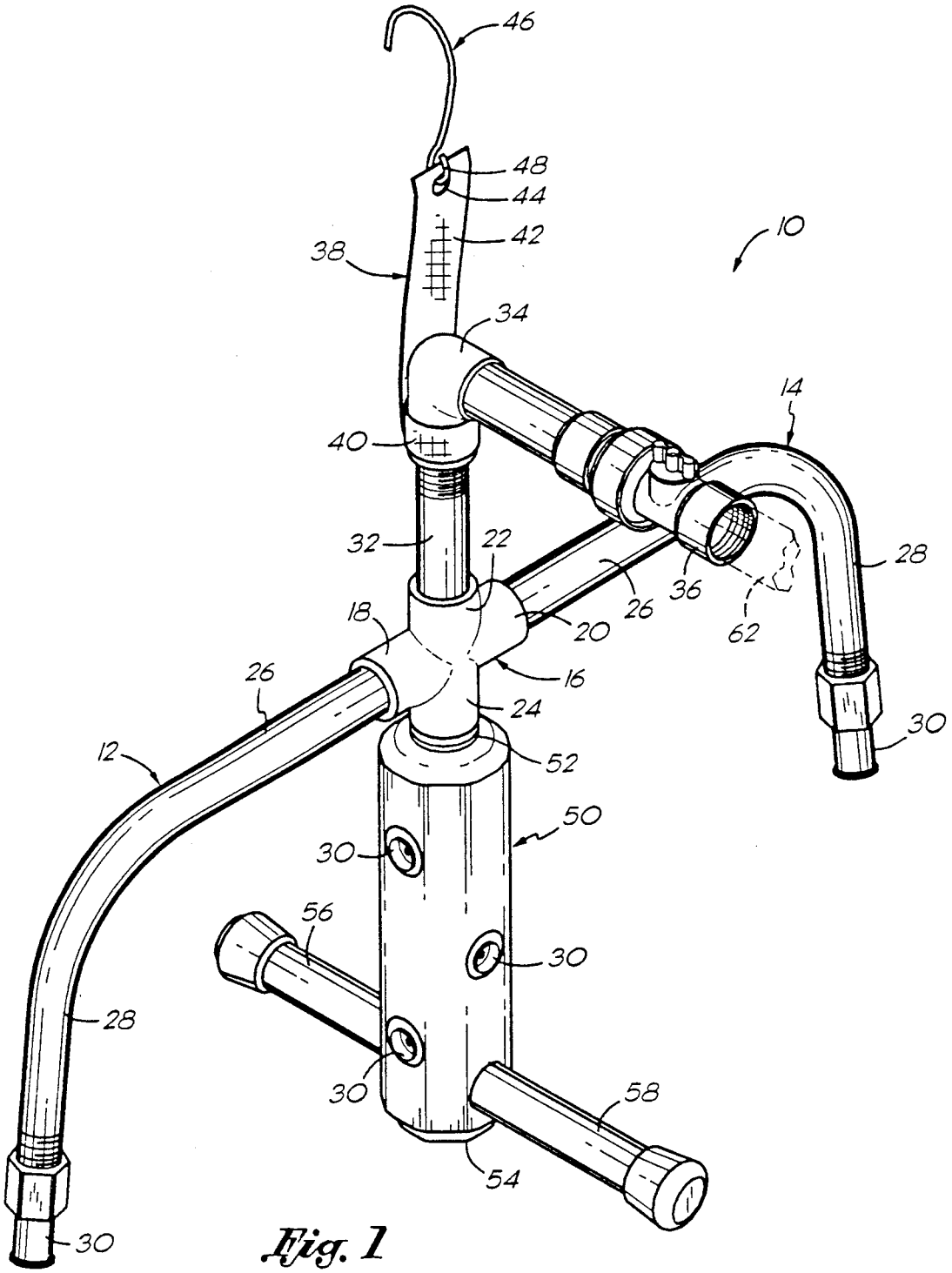
FIG. 1 is a perspective view of the wet suit hanger of the present invention, in a preferred form.

Referring now to FIG. 1, there is shown generally at 10, a wet suit spray hanger 10 embodying the present invention in a preferred form. The hanger 10 comprises a pair of support hanger arms 12, 14 depending from a crossconnector 16. As illustrated, the cross-connector 16 has four branches: two horizontal branches 18, 20 and two vertical branches 22, 24 which are generally perpendicular to each other. Each of the arms 12, 14 comprise a generally L-shaped length of conduit, having an upper horizontal portion 26 which is rigidly secured within the horizontal branches 18, 20, of the hanger 10, respectively, and a downwardly extending portion 28 at the opposite end. Alternatively, each of the arms 12, 14 may comprise a substantially horizontal piece of conduit, having an elbow connector (not shown) attached to its outer end, and a second piece of conduit depending downwardly from the elbow connector. In either case, a spray head 30 is attached to each of the arms at the distal end of the downwardly extending portion.

Attached to the upper vertical branch 22 of the crossconnector 16 is a connecting conduit 32. The threaded end of connecting conduit 32 screws into an elbow joint 34, which is connected to a hose coupling 36. The opposite end of conduit 32 is permanently connected to upper branch 22.

For the reasons discussed below, the connection between conduit 32 and elbow joint 34 is preferably rotatable while providing a substantially fluid tight seal between the conduit and joint. A simple but effective means for achieving this is provided by the mating screw threads on conduit 32 and elbow joint 34 so that the inlet hose coupling may be rotated into the two positions shown respectively in FIGS. 1 and 2. It will be apparent that this joint need not be 100% watertight since a minor leakage of water in use would not adversely affect the overall operation of the spray hanger.

A sling 38, having a noose portion 40 and an elongate strap 42 having an opening 44 for receiving a hook 46 is provided as a convenient means for hanging the hanger 10 up. The sling 38 is preferably made of a reinforced nylon material, although other materials may be suitably employed. The noose portion 40 is sized to encircle the connecting conduit 32, and is prevented from slipping off the hanger 10 by the elbow portion 34. The opening 44 for the hook 46 is disposed near the top of the strap and is preferably reinforced with a metal eyelet. The hook 46 has a loop portion 48 which is fed through the eyelet 44 to secure the hook 46 to the hanger.

The lower vertical branch 24 of the cross-connector 16 is connected to an elongate rectangular body 50 via a nipple 52. Member 50 includes a hollow bore (not shown) having a threaded opening into which is screwed the nipple 52. Nipple 52 is thus in fluid communication with a plurality of spray heads 30. For the reasons discussed below, it is advantageous that the nipple 52 is rotatable with respect to the body 50 while providing a substantially fluid tight seal. A simple but effective means is provided by mating screw threads (not shown) on the end nipple 52 and in the end of the base of body 52 so that the body 50 is rotatable with respect to the crossconnector 16.

The opposite end of nipple 52 is permanently connected to the lower branch 24 of cross connector 16. An 0-ring 70 is provided between the nipple 52 and the cross-connector 16 so as to reduce leakage to a minimum. Again, an absolute seal is not necessary so long as any leak does not materially reduce the water pressure through the spray heads 30.

As shown in the drawing figures, the rectangular body 50 is provided with a plurality of spray heads 30, advantageously disposed along orthogonal axes on all four sides thereof at regularly spaced intervals. The spray heads 30 are mounted such that they are flush with the surface of the body 50. Preferably, the corners of the body are rounded so that there are no sharp edges. In addition, the bottom surface 54 of the body 50 is closed off so as to prevent water from running completely through the structure and to maximize water pressure through the spray heads 30.

A pair of transverse arms 56, 58 are provided proximate the bottom 54 of the rectangular body 50. The transverse arms 56, 58 are rigidly secured to opposite sides of the body, and aid in maintaining the wet suit in an open condition during both cleaning and drying. In addition, because the nipple 52 which connects the rectangular body 50 to the cross-connector 16 is rotatably mounted, the transverse arms 56, 58 may be rotated so that they are parallel to the arms 12, 14 for easy storage (see FIG. 2).

Figure 4:
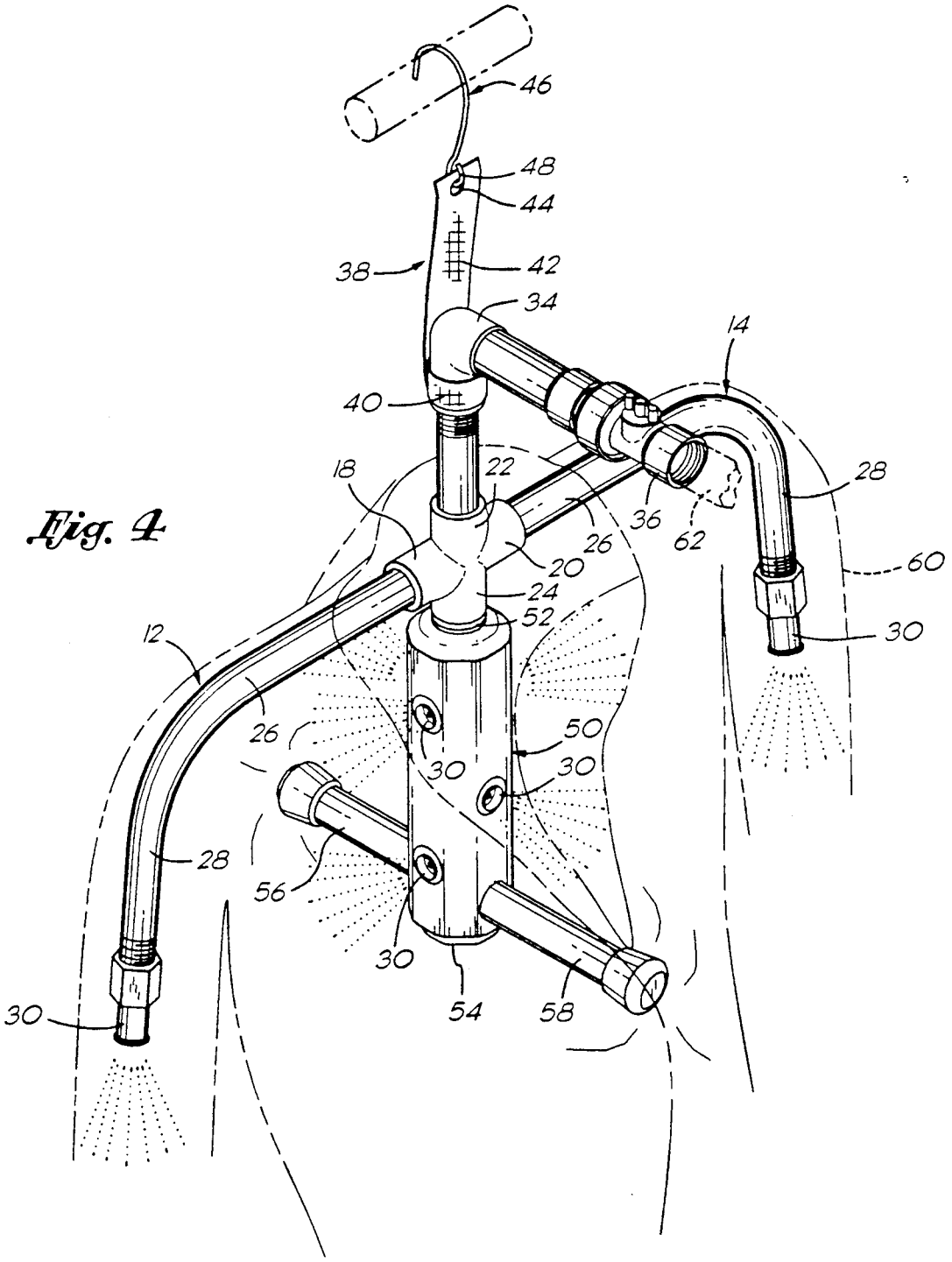
FIG. 4 is a schematic perspective view of the wet suit hanger in use showing a wet suit in phantom hanging thereon.

In use, as illustrated in FIG. 4, a wet suit 60 (shown in phantom) is hung over the arms 12, 14 of the hanger 10 so that the spray heads 30 at the distal ends on the downwardly extending portions 28 are aimed into the sleeves of the wet suit. In addition, the transverse arms 56, 58 are positioned generally perpendicular to the arms 12, 14 so as to hold the inside of the wet suit 60 open. A water hose 62 (shown in phantom) is then connected to the inlet hose coupling 36 and the water is turned on. After turning on the hose, water is forced through the spray heads 30 and courses through the wet suit. Once the water has been turned on, the chore of cleaning the wet suit may be left to the hanger 10, as it requires no direct attention.

A particular advantage of the structural configuration of the spray hanger 10 is that it provides a substantial number of spray heads in a compact unit. Thus, in the preferred embodiment, two opposite sides of body 50 have respectively two spray heads, and the remaining two opposite sides (on which are respectively mounted transverse arms 56, 58) have respectively one spray head. As a result, the wet suit hung on the spray hanger is, as shown in FIG. 4, subjected to a plurality of concentrated water sprays directed along mutually orthogonal axes so that the wet suit is quickly and thoroughly cleaned.

A significant advantage of the embodiment of the spray hanger shown in the figures and described above is that the wet suit does not have to be turned inside out in order to be thoroughly cleaned. Rather, as shown in FIG. 4, the wet suit is simply hung on the spray hanger 10, with the extending arms 12, 14 serving the function of a "coat hanger."

Another feature of the invention is that the transverse arms 56, 56, when positioned as shown in FIG. 1, space apart the juxtaposed interior surfaces of the front and back of the wet suit so that these surfaces are not allowed to cling together. As a result, the salts, sands and dirt are thoroughly washed off of these surfaces by the plurality of spray heads 30.

Figure 2:
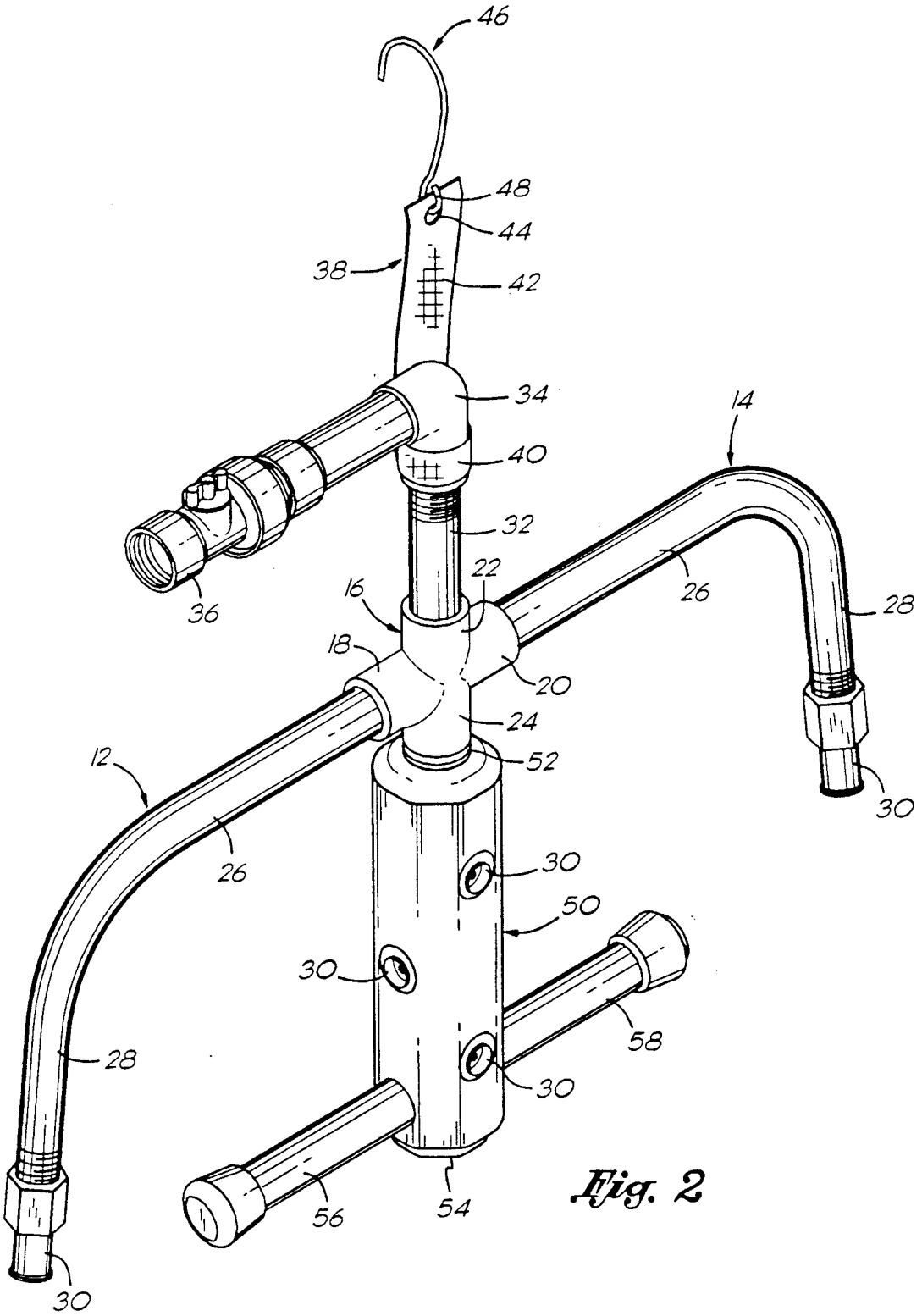
FIG. 2 is a perspective view of the wet suit hanger in FIG. 1, in a storage position.
Figure 3:
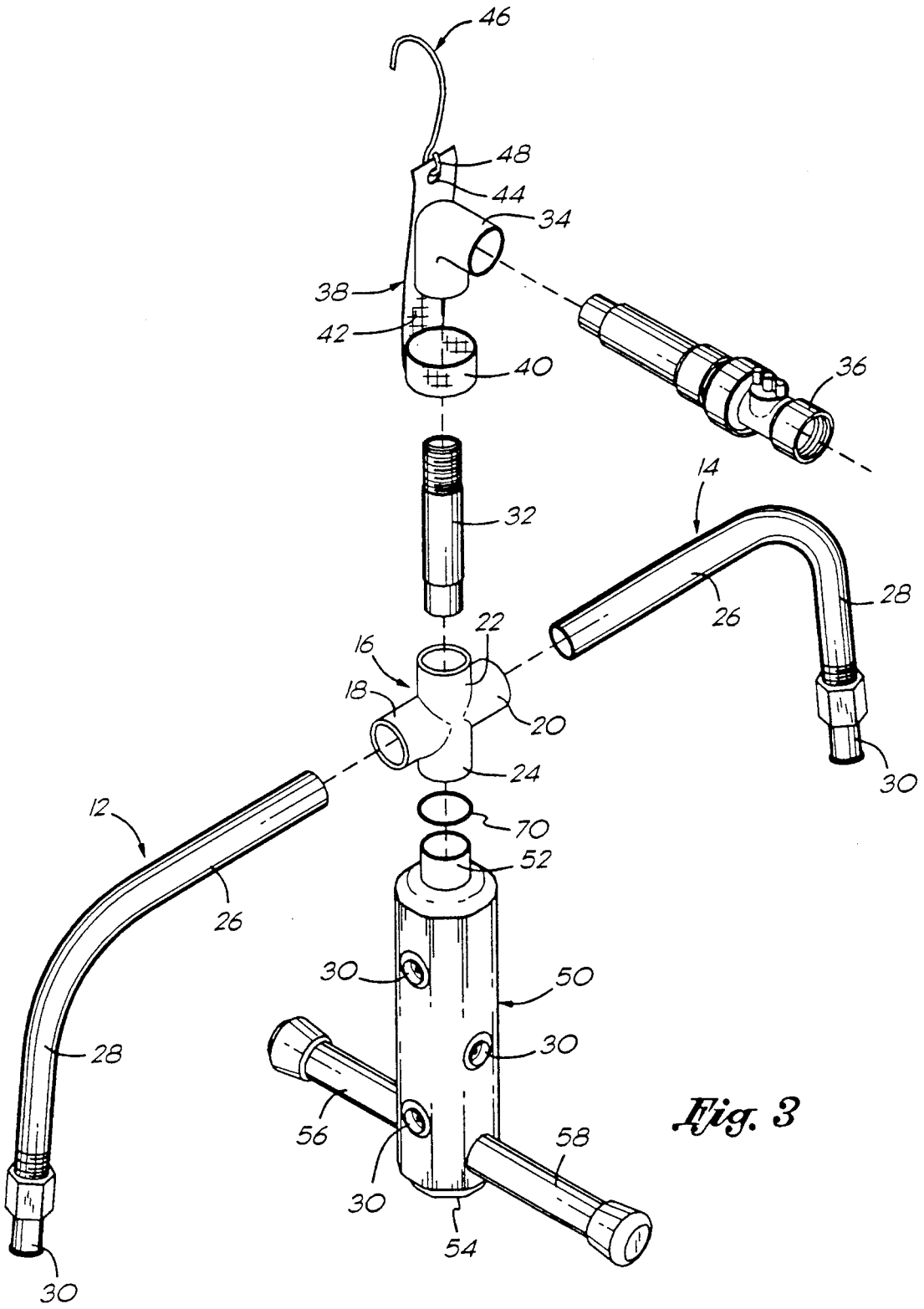
FIG. 3 is an exploded perspective view of the wet suit hanger illustrated in FIGS. 1 and 2.

It is important that a device such as spray hanger 10 be adopted for convenient storage. Accordingly, the preferred embodiment described herein has the advantage, as shown in FIG. 2, of being collapsible into a unitary structure having a very thin thickness dictated only by the external thickness of the body 50. As a result, the spray hanger 10 occupies little storage space in a closet when it is not being used. Yet, because of the swivel action provided by the screw threads in elbow 38, conduit 32, nipple 52 and body 50, the spray hanger 10 assumes a substantially different configuration in use with a substantially larger overall width, as shown in FIGS. 1 and 4.

Many other modifications and alternative embodiments of the invention will be apparent to those skilled in the art in view of the foregoing description. Accordingly, this description is to be construed as illustrative only, and is for the purpose of teaching those skilled in the art the best mode of carrying out the invention. The details of the structure may be varied substantially without departing from the spirit of the invention, and the exclusive use of all modifications which come within the scope of the appended claims is reserved.

I claim:

1. A spray hanger for holding and cleaning salt, sand, dirt and sea water from a wet suit without (i) having to turn the wet suit inside out, (ii) having to manually hose down any portion of the inside of the wet suit, and (iii) manually hold apart the juxtaposed surfaces of the front and back of the wet suit, while providing a spray hanger which collapses to an easily stored unitary structure having a thickness substantially smaller than the thickness of the spray hanger when it is in use, said spray hanger comprising:

a pair of hollow support hanger arms configured to function both as a "coat hanger" and to provide a fluid path for water flowing therethrough;

a spray head mounted at the distal end of each of said hollow support hanger arms;

a body supporting a plurality of spray heads for projecting sprays of water along mutually orthogonal axes;

a hollow coupling connected to said pair of hollow support hanger arms and to said body for delivery of water to the spray heads at the distal ends of said hanger arms and the spray heads in said body;

a hose coupling connected to said hollow coupling for connecting a water hose thereto;

a pair of transverse arms attached to said body for holding apart the front and back juxtaposed interior surfaces of said wet suit; and a swivel connector between said body and said hollow coupling so that (a) when a set suit is hung upon the spray hanger, said body is rotated so that said transverse arms are positioned substantially orthogonal to said pair of hollow support hanger arms so as to hold apart the front and back juxtaposed interior surfaces of said wet suit, and (b) when said set suit is taken off of the spray hanger, said body is rotated so that said transverse arms are in substantially the same plane as said hollow support hanger arms so that the spray hanger is collapsed to an easily stored unitary structure having a thickness substantially no greater than the thickness of said body.

2. A spray hanger for holding and cleaning a wet suit, comprising:

an elongate hollow rectangular body, having first and second ends;

a plurality of spray heads inset at regularly spaced intervals about said rectangular body;

a pair of hollow arms, in fluid communication with said rectangular body at said first end, each of said hollow arms having a horizontal section substantially perpendicular to said rectangular body;

a pair of solid arms secured to said rectangular body, proximate said second end, said solid arms substantially perpendicular to said horizontal section of said hollow arms; and an inlet hose coupling, suitable for connection to a source of fluid, said hose coupling in fluid communication with said hollow arms and said rectangular body.

3. A wet suit hanger, as defined by claim 2, wherein each of said hollow arms further comprises a downwardly extending section having a spray head mounted at the end thereof.

4. A wet suit hanger as defined by claim 2, further comprising:

a connecting conduit, rotatably mounted and extending from said first end of said rectangular body; and an elbow joint, disposed between said inlet hose coupling and said connecting conduit.

5. A wet suit hanger, as defined by claim 4, further comprising:

a sling, having a noose portion which encircles said connecting conduit and an elongate strap; and a hook for hanging said hanger, said hook connected to said elongate strap portion of said sling.

6. A method of cleaning a wet suit, comprising the steps of:

hanging said wet suit on a set of hollow hanger arms having a water spray head mounted at their respective distal ends;

positioning a second set of arms substantially perpendicular to said first set of arms so as to maintain said wet suit in an open position;

connecting said hollow hanger arms to a source of cleaning fluid; and allowing said fluid to course through said spray heads and into said wet suit.

* * * * *